US008657218B2

(12) United States Patent
Wang

(10) Patent No.: US 8,657,218 B2
(45) Date of Patent: Feb. 25, 2014

(54) SYSTEM AND METHOD FOR SEPARATING MINERALS FROM ORE WITHOUT FLUID

(76) Inventor: Zhongwu Wang, Beijing (CN)

( * ) Notice: Subject to any disclaimer, the term of this patent is extended or adjusted under 35 U.S.C. 154(b) by 80 days.

(21) Appl. No.: 13/384,325

(22) PCT Filed: Nov. 1, 2011

(86) PCT No.: PCT/CN2011/081632

§ 371 (c)(1),
(2), (4) Date: Jan. 16, 2012

(87) PCT Pub. No.: WO2012/139372

PCT Pub. Date: Oct. 18, 2012

(65) Prior Publication Data

US 2013/0062443 A1 Mar. 14, 2013

(30) Foreign Application Priority Data

Apr. 11, 2011 (CN) ..... 2011 1 0089725

(51) Int. Cl.
*B02C 23/08* (2006.01)

(52) U.S. Cl.
USPC ..... 241/79.1; 241/175

(58) Field of Classification Search
USPC ..... 241/19, 79, 79.1, 175
See application file for complete search history.

(56) References Cited

U.S. PATENT DOCUMENTS 3,863,847 A * 2/1975 Day et al. ..... 241/14
5,593,096 A * 1/1997 Harker et al. ..... 241/14
7,204,439 B2 * 4/2007 Fuller ..... 241/79.3
8,302,890 B2 * 11/2012 Lewis-Gray ..... 241/30
2002/0179500 A1 12/2002 Tsutsumi
2005/0279868 A1 * 12/2005 Fuller ..... 241/79
2012/0199677 A1 * 8/2012 Blo ..... 241/65
2013/0092769 A1 * 4/2013 Schenk ..... 241/24.12

FOREIGN PATENT DOCUMENTS

CN 1096309 C 12/2002
CN 1765527 A 5/2006
CN 101385992 A 3/2009
CN 201493166 A 6/2010

* cited by examiner

*Primary Examiner* — Faye Francis

(74) *Attorney, Agent, or Firm* — Andrew W. Chu; Craft Chu PLLC

(57) ABSTRACT

The system and method of separating minerals from ore without fluid includes a materials feeding device, a friction vibration separator and a dry separation concentrator, the materials feeding device passing a dry mixture to the friction vibration separator. At least two materials transport grooves collect the rough separation mixture from the friction vibration separator to at least two materials transport devices for passing the rough separation mixture to the dry separation concentrator. The method includes crushing ore into a mixture of minerals and ore, drying the mixture, storing and transporting the dry mixture to the friction vibration separator by the materials feeding device, collecting a rough separation mixture from the friction vibration separator, transporting the rough separation mixture to a dry separation concentrator to collect a collection mixture.

12 Claims, 5 Drawing Sheets

SYSTEM AND METHOD FOR SEPARATING MINERALS FROM ORE WITHOUT FLUID

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This invention relates to a system and method of separating minerals from ore without fluid. The invention also relates to dry separation without water. The invention further relates to gravity separation.

2. Description of Related Art Including Information Disclosed Under 37 CFR 1.97 and 37 CFR 1.98.

In mining and industrial production, minerals are usually embedded in rocks or exist in the soil. Generally, minerals are exposed through crushing and grinding, and then fluids dissolve the powdered minerals to separate and concentrate the minerals from the other substances in the crushed ore. The prior art system uses the relationship between the different chemicals (with exceptions like iron ore) and minerals to separate and to concentrate the minerals in fluid, until the content of minerals reaches some degree of concentration before they are to be smelted.

Vibrating fluidized beds and wash boxes are usually employed at the moment. Among others, for vibrating fluidized beds, current research primarily focuses on uniformity and drying issues of fine grain particles fluidization. Generally, it is claimed that particles with large density sink to the bottom; however, this principle alone is far from meeting industrialization requirements for consistently separating minerals.

Though wash boxes have been applied by human beings for more than one hundred years, its working principle remains unimproved. Water is necessary as the medium, and manual drive control to the medium is needed. The smallest diameter of a recoverable heavy mineral particle is 0.02 mm, and only small mineral particles can be detected in recovered minerals without indicating the actual recovery rate of small mineral particles. Generally speaking, it is not suitable to operate in conditions where all particles are small particles. Moreover, much ore is required to be crushed to a small size to reach a 90% exposed state in order to separate minerals from the ore.

Thus, inventing a system and method without chemicals, including being capable of separating minerals from ore without water as the medium has become a new development in mineral separation technology.

SUMMARY OF THE INVENTION

To counter the drawbacks of the prior art, a system and method of separating mineral from ore utilizes air as a medium. The invention accomplishes the purposes of separating simply, decreasing production cost, separating without water or any chemicals, being able to exploit mines where production cannot be carried on due to lack of a water source, and being able to exploit resources whose priming cost is high.

The method of the present invention includes crushing ore and drying the crushed materials, and processing dry materials by vibration and air flow of a dry separation concentrator. Materials are concentrated in conditions of airflow ventilation and vibration of a directional vibrator. Materials are separated by turbulence flow field formed by perforated boards, the included angle between the perforated boards and the horizontal direction being 2~20°, the thickness of the materials being ≤40 MM.

The beneficial effect of the method in this invention is that separation can be done without using chemicals, water being not necessary as medium. Minerals can be concentrated and separated in conditions of using air as the medium only, the process being simple and pollution free. Costs are saved. Mineral resources are able to be exploited partly in areas that lack of water or have difficulty in priming water, and useful substances contained in obsolescing tailings during production may also be recovered and reused.

On the basis of the technical solution mentioned above, improvements as follows may also be made to this invention.

Further, the directional vibrator of the dry separation concentrator has perforated boards with uniformly distributed micro-pores, the spacing between the micro-pores being 50-500 μm, which is less than 1.2 times of the particle diameter of the largest particles group in materials for separation. The pore diameter of the micro-pores being less than ⅓ of the spacing. Further, there can exist, between the crushing step and the vibrating, separating, and collecting steps by the dry separation concentrator, steps for processing the dry mixture into a rough separation mixture by another directional vibrator with different structures, called a friction vibration separator. The rough separation mixture is then further separated into portions by a granularity classification step in which materials are roughly separated in conditions of vibration of that friction vibration separator with the another directional vibrator.

The beneficial effect of employing the solution mentioned above is that a lot of fine powders whose diameter is less than 0.1 MM are unavoidably produced during the step of crushing, and it is inefficient and costly if a screen is used to separate the fine powders. There is a good separation effect achieved when materials are separated by friction vibration first for a rough separation mixture, and fine powders and fine particles therein are separated and concentrated, respectively.

Further, the directional vibrator of the dry separation concentrator and the horizontal direction forms an angle of 20~60°, while the directional vibrator of the friction vibration separator for rough separation and the horizontal plane forming an angle of 25~60°. The dry separation concentrator has the first directional vibrator, and the friction vibration separator has the second directional vibrator, even though a preferred embodiment of the present invention passes the dry mixture through the second directional vibrator before the rough separation mixture passes through the first directional vibrator. Other embodiments only use the dry separation concentrator and the first directional vibrator, so the dry separation concentrator has the first directional vibrator. The friction vibration separator and second directional vibrator are not included in all embodiments.

Further, materials are roughly separated for particles classification by a second vibrator in a friction vibration separator by way of spot blanking, and the materials with different particles classifications after the rough separation are each fed into a dry separation concentrator. The groups are fed to different dry separation concentrators, respectively, for concentration by way of line blanking. The distance between the drop points of the roughly separated materials and either the concentrated materials or the materials layer are both <20 mm.

Further, the airflow flows at 0.2~20 $cm^3/s$; the vibration frequency of the second vibrator for rough separation being 20~30 HZ, with the amplitude of vibration 2-10 mm; the vibration frequency of the first vibrator of the dry separation concentrator being 22~33 HZ, with the amplitude of vibration 0.3-3 mm. The beneficial effect of employing the solution mentioned above is that the light and heavy materials are separated, producing directly desired results.

Embodiments of the system for separating minerals from ore without fluid includes a materials feeding device, a friction vibration separator and a dry separation concentrator. The materials feeding device is setup above the friction vibration separator, and at least two materials transport grooves are setup below the friction vibration separator. There are materials transport devices that are connected with the at least two materials transport grooves to deliver the rough separation materials to the dry separation concentrator. The beneficial effect of the system in this invention is that the materials can be separated in conditions of using air as medium by way of a friction separator and a dry separation concentrator, the method being simple, the cost being low, the water resource being saved; and there is fundamentally no pollution after dust collection.

Further, the friction vibration separator comprises the second vibration platform that is setup on the second vibrator. The said second vibration platform and vibration agitation force direction form an angle of 25~60°, and at least one separation board forms an angle of 20-50° with the second vibration platform setup on the second vibration platform. The at least one separation board and the vertical direction of the vibration agitation force direction form an angle of 0~8°, and the at least one separation board is setup on the at least two materials transport grooves. The materials feeding device is setup on the top right of the at least one separation board.

The beneficial effect of employing the technical solution mentioned above is that minerals can be separated according to its different granularity by applying vibration friction force through the platform and the separation board that are setup to form a tilted angle with the agitation force.

Further, the separated materials are guided into at least two materials transport grooves by the at least one separation board through a guide plate.

Further, the dry separation concentrator comprises the first vibration platform that is setup on the directional first vibrator. The second vibration platform and the agitation force direction form an angle of 20~60°, and at least one groove is setup on the first vibration platform. The groove is setup below a materials feeding inlet, and a perforated board forms an angle of 2~20° with the second vibration platform being setup in the at least one groove. An airtight air chamber is setup below the perforated board, an air hole, at least one deposits outlet and at least one extraction outlet of the groove is setup on the side wall of the at least one groove. There is the first orifice plate, the second orifice plate, the third orifice plate and the fourth orifice plate setup on the periphery of the side walls of the groove. The deposits outlet is setup on one side of the lower end of the perforated board on the side wall of the groove, and the extractions or overflow outlet is setup on one side of the higher end of the perforated board on the side wall of the groove.

The beneficial effect of employing the technical solution mentioned above is that minerals can be concentrated and separated according to its different density by way of the vibration platform and the perforated board that are setup to form a tilted angle with the agitation force, lighter materials being separated continuously by the extractions outlet settings in an overflow way, achieving good separation effect.

Further, materials transport grooves are setup with respect to the at least one deposits outlet and the at least one extractions outlet. Deposits and extractions are both guided through a guide plate into the transport grooves that are setup with respect to the deposits outlet and the extractions outlet.

Further, a deposits outlet is setup on the at least one groove, a controllable opening and closing port device being setup on one side wall. The first orifice plate is setup on one side of the higher end of the perforated board, which is 0.5~10 mm higher than the higher end of the perforated board, the second orifice plate, the third orifice plate and the fourth orifice plate being 20 mm higher than the higher end of the perforated board.

The beneficial effect of employing the technical solution mentioned above is that deposited heavy materials are easily let out through the controllable opening and closing device. The settings of the other three orifice plates are lower than the orifice plate at the higher end of the perforated board, so as to be capable of preventing the heavy materials from being carried out by light materials and at the same time providing an outlet for the light materials to overflow.

Further, the number of the at least one deposits outlet can be two, which corresponds to the two strokes, the upward stroke and the downward stroke, of the controllable opening and closing device.

The beneficial effect of employing the technical solution mentioned above is that heavier and very much heavier materials can be separated out according to different density.

Further, the first vibrator and the second vibrator are both fixed on a respective bracket through a respective helical spring.

The beneficial effect of employing the technical solution mentioned above is that the purpose of directional vibration is achieved, which is required for the separation of the particles granularity and the output of materials, and is also beneficial for the separation according to density.

DETAILED DESCRIPTION OF THE DRAWINGS

Principles and features of this invention will be described below with reference to drawings. The examples cited are used only for explaining the invention, not for limiting the scope of this invention.

Embodiment 1

Preliminary Screening of Ore

Iron ore is crushed by a crusher and dried. The dried materials are roughly separated for particles classification by a friction vibration separator in conditions of vibration of the directional second vibrator by way of spot blanking. Particles of iron ore with diameter 0.45-0.06 MM are separated into iron ore with diameter 0.1-0.06 MM, iron ore with diameter 0.25-0.1 MM and iron ore with diameter 0.45-0.2 MM according to the diameter of the particles. The vibration frequency of the second vibrator is 21 HZ, with the amplitude of vibration 6 mm.

Concentration of the Ore after Rough Separation

Each of the three groups of iron ore separated above are transported to a dry separation concentrator. Each group is further concentrated in conditions of different airflow ventilation and vibration of a directional first vibrator by way of line blanking, the vibration frequency of the first vibrator being 30 HZ, with the amplitude of vibration 0.3~3 mm. Uniformly distributed micro-pores are set on perforated boards in the second vibrator, the pore diameter of the said micro-pores being less than 30 μm, the particle diameter of the materials<450 μm, the spacing between the perforated boards used for separating materials≤100 μm, the thickness of the materials used for separation on the perforated boards≤40 MM. The iron ore with diameter 0.1-0.06 MM, iron ore with diameter 0.25-0.1 MM and iron ore with diameter 0.45-0.2 MM are each separated by way of different airflows flowing within 1-6 $cm^3/s$.

Figure 1:
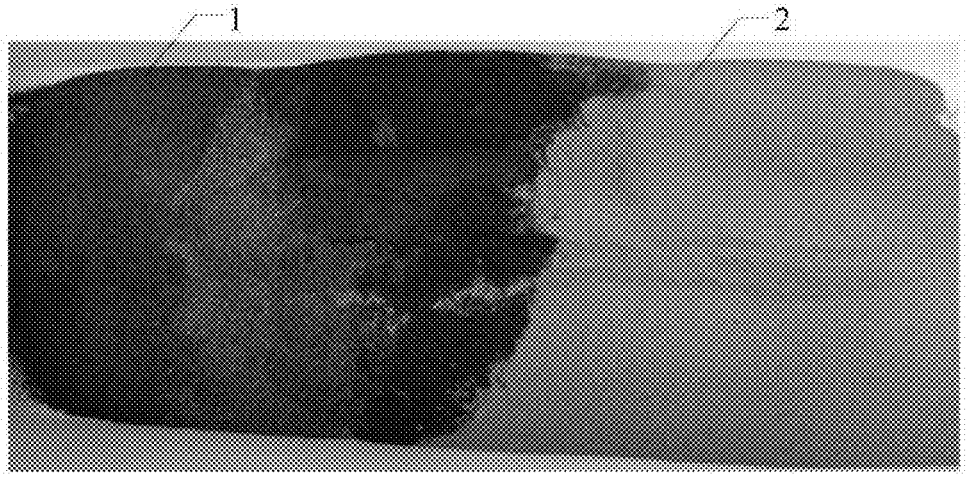
FIG. 1 is a photograph showing contrast results of the deposits and overflow or extractions concentrated and separated from iron ore with diameter 0.1-0.06 MM by means of the method of an embodiment of the invention, 1 indicating deposits and 2 indicating extractions in the photo.
Figure 2:
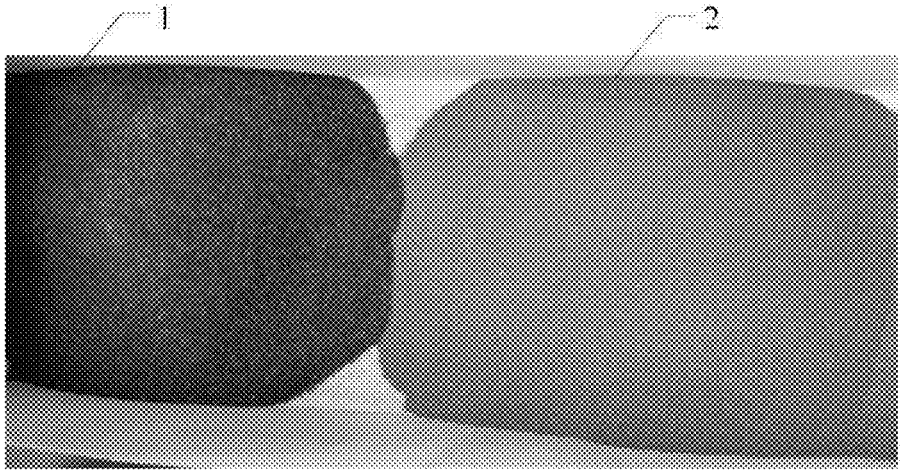
FIG. 2 is a photograph view showing results of the deposits and extractions concentrated and separated from iron ore with diameter 0.25-0.1 MM by means of the method of the embodiment of FIG. 1 of the invention, 1 indicating deposits and 2 indicating extractions in the photo.
Figure 3:
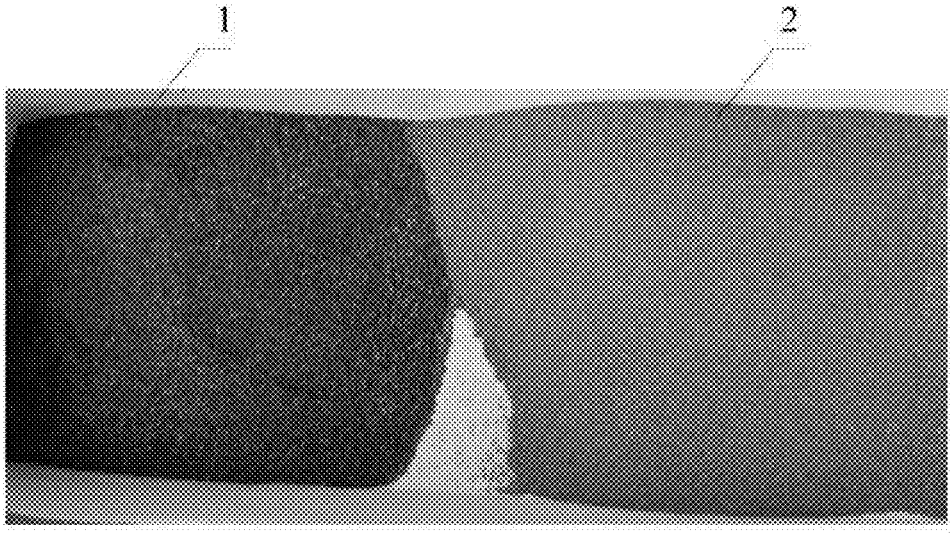
FIG. 3 is a photograph showing results of the deposits and extractions separated from iron ore with diameter 0.45-0.2 MM by means of the method of the embodiment of FIG. 1 of the invention, 1 indicating deposits and 2 indicating extractions in the photo.

FIG. 1 is a photograph showing results of the deposits and extractions after the separation of the iron ore with particle diameter 0.1-0.06 MM, the first group of rough separation materials. As can be seen from the figure, the separation effect meets the industrial production requirements, the recovery rate being larger than 92% by way of simple measurement using magnets. FIG. 2 is a photograph showing results of the deposits and extractions after the separation of the iron ore with particle diameter 0.25-0.1 MM, the second group of rough separation materials. As can be seen from the figure, the separation effect meets the industrial production requirements, the recovery rate being larger than 94% by way of simple measurement using magnets. FIG. 3 is a photograph showing results of the deposits 1 and extractions 2 after the separation of the iron ore with particle diameter 0.45-0.2 MM, the third group of rough separation materials. As can be seen from the figure, the recovery rate is quite high; however, some amount of sands is entrapped in the finished products (The reasons have been identified until now).

Therefore, the separation effect of the method in the invention is remarkable and meets the industrial requirements, the recovery rate being larger than 92% except for the smallest particles (with diameter less than 0.06 MM).

Embodiment 2

The ilmenite, which is located in Dali, Yunnan Province, is the ilmenite with the content being 18% and meshes being 60%. The percentage of ore particles with diameter under 0.1 MM in the ore are less than one percent, thus a simplified process is employed. There is no rough separation in a second vibrator of a friction vibration separator. After the soil is stripped by a sand maker, the ilmenite is fed directly into the dry separation concentrator. The soil material is concentrated in conditions of airflow ventilation and vibration of the directional first vibrator by way of line blanking, the vibration frequency of the first vibrator being 30 HZ, with the amplitude of vibration 0.3-3 mm. Uniformly distributed micro-pores are set on the perforated boards in the first vibrator, the spacing between the micro-pores<100 μm, the pore diameter of the micro-pores being less than 30 μm.

Figure 4:
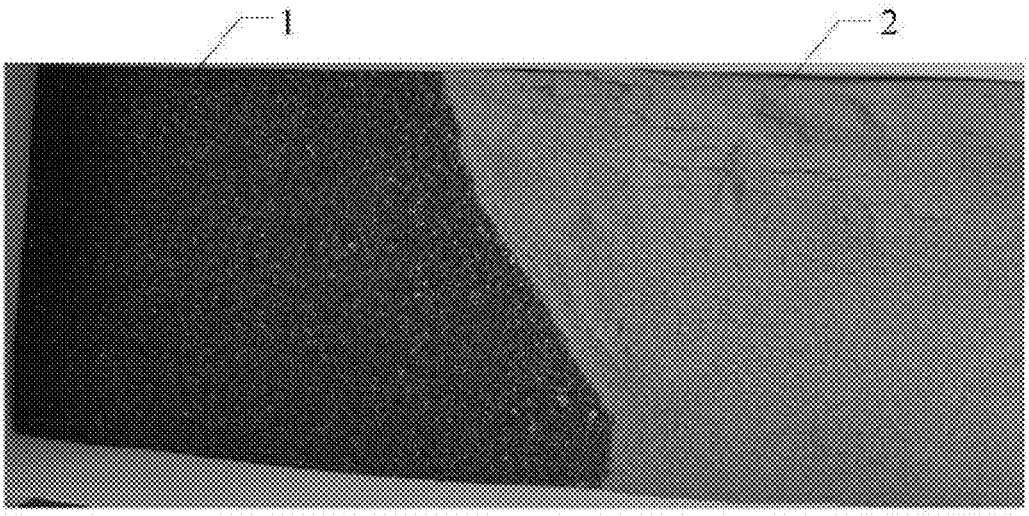
FIG. 4 is a photograph showing results of the deposits and extractions separated from ilmenite by means of the method of another embodiment of the invention, 1 indicating deposits and 2 indicating extractions in the photo.

FIG. 4 is a photograph showing results of the deposits and extractions after the separation of the ilmenite. As can be seen from the figure, the separation effect is quite good, wherein the recovery rate reaches as high as 98% or above.

Figure 5:
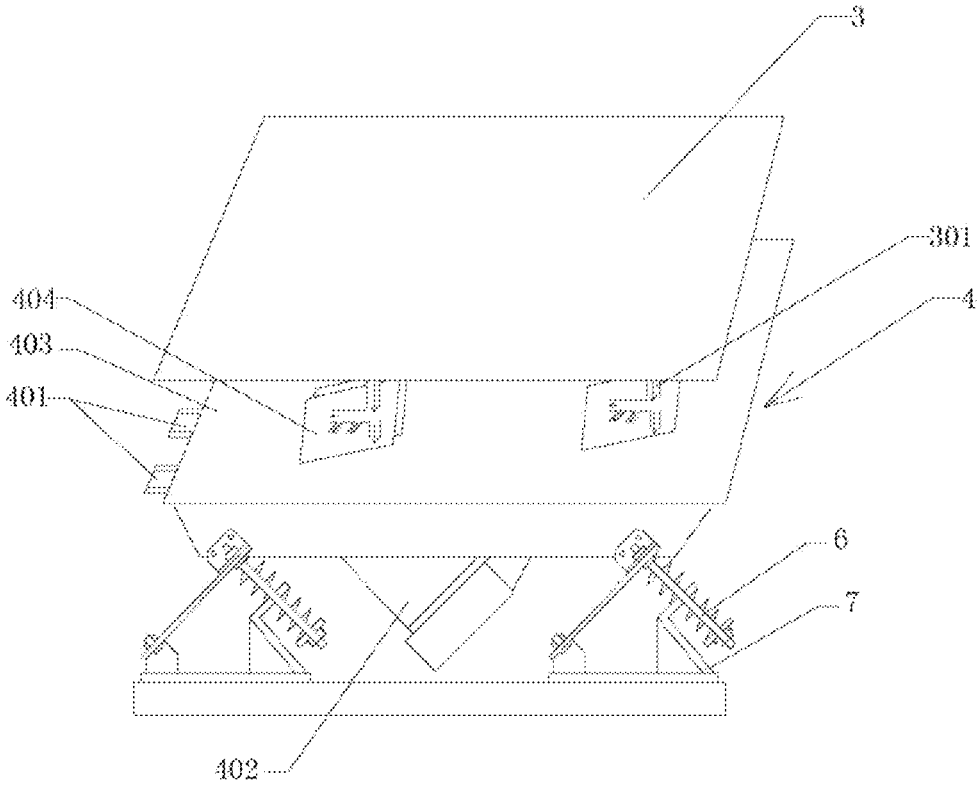
FIG. 5 is a schematic view showing the structure of the friction vibration separator of the system according to a first embodiment of the invention.
Figure 6:
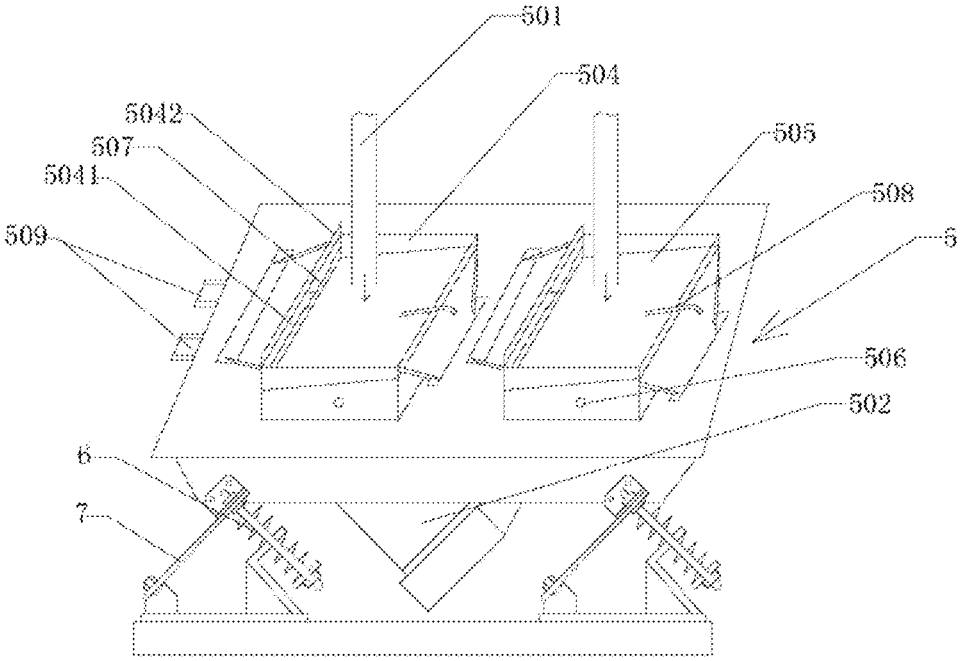
FIG. 6 is a schematic view showing the structure of the dry separation concentrator of the system according to the first embodiment of the invention.

As can be seen from FIGS. 5-6, the system for separating minerals from ore, according to Embodiment 1 comprises a materials feeding device 3, a friction vibration separator 4 and a dry separation concentrator 5. The materials feeding device 3 is setup above the friction vibration separator 4, and at least two materials transport grooves 401 are setup below the friction vibration separator 4. There are materials transport devices that are connected with at least two materials transport grooves 401. The materials transport devices deliver the rough separation materials to the two materials feeding inlets 501.

The friction vibration separator 4 comprises a second vibration platform 403 that is setup on the first vibrator 402. The second vibration platform 403 has an agitation force direction forming an angle of 25~60°. At least one separation board 404 forms an angle of 20-50° with the second vibration platform 403 on the second vibration platform 403. The at least one separation board 404 and the vertical direction of the vibration agitation force form an angle of 0~8°, the at least one separation board 404 being setup above the two materials transport grooves 401, the separated materials being guided into the two materials transport grooves 401 by the at least one separation board 404 through a guide plate. The distance between the opening for materials to fall in 301 of the materials feeding device 3 and the top right of the at least one separation board 404 is 5~8 mm.

The dry separation concentrator 5 comprises a first vibration platform 503 that is setup on the first vibrator 502. The first vibration platform 503 has an agitation force direction forming an angle of 40°, and at least one groove 504 is setup on the first vibration platform 503. The groove 504 is setup below the materials feeding inlet 501. The materials separate according to different density by the action of a tilted turbulence flow field. A perforated board 505, which forms an angle of 5° with the first vibration platform 503, is setup in the at least one groove 504, material with good vibration conductivity being employed by the perforated board 505. There is spacing between turbulence flow groups along the perforated board and orifice plates for high quality uniform distribution of particles. The spacing between the perforated board is less than or equal to 1.2 times of the particle diameter of the largest deposited high density particles group in the objective particles to be separated, the width of the perforated board 505 being 60~400 mm, an airtight air chamber being setup below the perforated board 505 in the groove. An air hole 506, a deposits outlet 507 and an overflow port 508 are setup on the side wall of the groove 504. The deposits outlet 507 is setup on the side wall at one lower end side of the perforated board of the groove, and the overflow port 508 s setup on one side of the higher end of the perforated board of the groove. There is the first orifice plate, the second orifice plate, the third orifice plate and the fourth orifice plate being setup on the periphery of the side walls of the groove 504. A controllable opening and closing port device 5041 is setup on the side wall at one lower end side of the perforated board 505 as well. The first orifice plate is both the higher end orifice plate of the perforated board and the overflow port 508 for an extractions outlet. The first orifice plate 508 is setup on the side wall at one higher end side of the perforated board 505, the first orifice plate 508 being 0.5-10 mm higher than the higher end of the perforated board 505, and this first orifice plate 508 is lower than orifice plates on other side walls. The orifice plates on other side walls, i.e. the second orifice plate, the third orifice plate and the fourth orifice plate, are 20 mm higher or more than the perforated board 505. The thickness of the largest materials on the perforated board 505 in the groove 504 is no more than 40 mm, and the thickness of the thinnest materials being 0.5-10 MM. The distance between the materials feeding inlet 501 and the side wall of the lower end of the perforated board 505 of the groove 504 is 20~40 mm. The materials transport grooves 509 are setup below the deposits outlet 507 and the overflow port 508 for the extractions or overflow outlet, which. Deposits and extractions are both guided through the guide plate by the deposits outlet 507 and the overflow port 508 of the extractions outlet into the transport grooves 509. The second vibrator 402 and the first vibrator 502 are both fixed on a bracket 7 through a helical spring 6.

Figure 7:
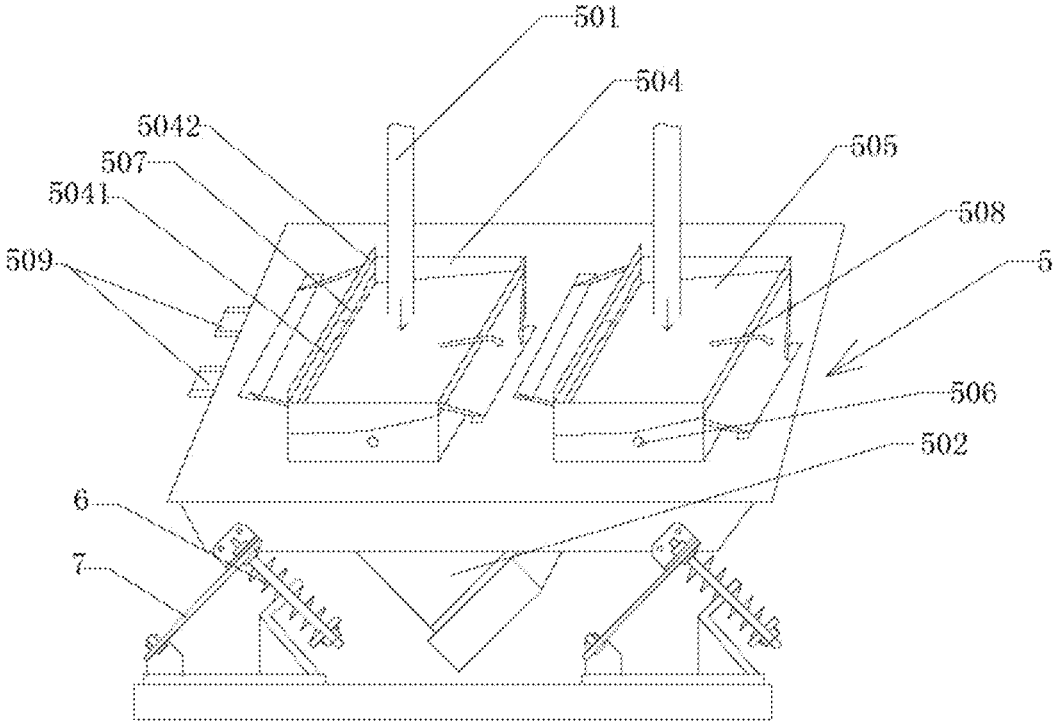
FIG. 7 is a schematic view showing the structure of the dry separation concentrator of the system according to a second embodiment of the invention.

As can be seen from FIG. 7, there is a second embodiment of the system for separating ilmenite, according to Embodiment 2 of the invention. The perforated board 505 is slightly curved, being capable of increasing the volume of the deposits at the bottom. The controllable opening and closing port device of the materials outlet is divided into two parts, the upper part and the lower part, being capable of controlling opening and closing state, respectively. It is designed for deposits with two different densities, being suitable for use when the content of one extremely heavy deposit is very low.

Another embodiment of the system of the invention is shown in FIG. 6, which shows the two grooves 504 as one group. In an alternative embodiment, the height of one of the grooves 504 is increased, making a higher outlet for materials, such that the higher guide plate feeds material to a second groove 504. The extractions of the first higher groove enter into the second lower groove to be concentrated again in conditions of decreasing the airflow amount, with the advantages of increasing the range of concentrated particles and the recovery rate.

The above are just preferred embodiments of this invention, but are not for limiting this invention. Any modifications, equivalents, improvements, etc. that are made within the spirit and the scope of this invention should all be included in the claimed scope of this invention.

I claim:

1. A system for separating minerals from ore, said system comprising:

a materials feeding device, wherein a dry mixture of ore and minerals is stored and transported in said materials feeding device; and a dry separation concentrator receiving a mixture flow from said materials feeding device, said dry separation concentrator comprising:

a first directional vibrator generating a first agitation force;

a first vibration platform mounted above said first directional vibrator, said first vibration platform and a direction of said first agitation force forming an angle of 20-60 degrees; and a groove on a top surface of said first vibration platform, said groove being comprised of a materials feeding inlet, a perforated board forming an angle of 2-20 degrees with said first vibration platform, an airtight air chamber below said perforated board, an air hole in a side wall of said groove, a deposit outlet being on a lower end of said perforated board, and an overflow outlet being on a higher end of said perforated board and being on said side wall of said groove.

2. The system of claim 1, further comprising:

a plurality of orifice plates around a periphery of said groove.

3. The system of claim 2, wherein said plurality of orifice plates is comprised of a first orifice plate, a second orifice plate, a third orifice plate and a fourth orifice plate positioned around sides of said groove.

4. The system of claim 3, further comprising:

an actuatable port device having an opened and closed position and being mounted on said side wall of said groove, wherein said first orifice plate is mounted on a side of said groove corresponding to said higher end of the perforated board, said first orifice plate being 0.5-10 mm higher than said higher end of said perforated board, and wherein said second orifice plate, said third orifice plate and said fourth orifice plate are at least 20 mm higher than said higher end of said perforated board.

5. The system of claim 1, further comprising:

a friction vibration separator receiving said dry mixture of ore and minerals of said materials feeding device, said friction vibration separator comprising:

a second directional vibrator generating a second agitation force;

a second vibration platform mounted above said second directional vibrator, said second vibration platform and a direction of said second agitation force forming an angle of 25-60 degrees;

a separation board forming an angle of 20-50 degrees with said second vibration platform and forming an angle of 0-8 degrees with a vertical direction of said second agitation force; and at least two materials transport grooves connected to said separation board, the materials transport grooves collecting a rough separation mixture, wherein said mixture flow from said materials feeding device to said dry separation concentrator is comprised of said rough separation mixture.

6. The system of claim 5, wherein said materials feeding device removably engages a top right corner of said separation board, said dry mixture passing from said materials feeding device to said separation board of said friction vibration separator, and wherein said rough separation mixture passes from the materials transport grooves to said materials feeding inlet of said dry separation concentrator.

7. A method of separating minerals from ore, said method comprising:

providing a system according to claim 5 crushing materials into a mixture of ore and minerals;

drying said mixture of ore and minerals so as to form a dry mixture of ore and minerals;

storing and transporting said dry mixture in said materials feeding device;

passing said dry mixture from said materials feeding device to said separation board of said friction vibration separator, said materials feeding device engaging a top right corner of said separation board;

vibrating said dry mixture on said separation board forming an angle of 20-50 degrees with said first vibration platform, said dry mixture being exposed to airflow ventilation;

separating said dry mixture by particle size by turbulence flow field across said separation board; and collecting said dry mixture by particle size into a rough separation mixture from said at least two materials transport grooves;

passing said rough separation mixture to said materials feeding inlet of said dry separation concentrator;

vibrating said rough separation mixture on said perforated board forming an angle of 2-20 degrees with said first vibration platform, said rough separation mixture being exposed to airflow ventilation;

separating said rough separation mixture by particle size by turbulence flow field across said perforated board; and collecting said rough separation mixture by particle size into a collection mixture from said deposit outlet of said dry separation concentrator.

8. The method of claim 7, wherein said perforate board is comprised of uniformly distributed micro-pores, said micro-pores being spaced 50-500 μm apart from each other, and said micro-pores having a pore diameters less than one third of spacing apart from each other.

9. The method of claim 7, wherein said step of collecting said dry mixture by particle size into a rough separation mixture from said at least two materials transport grooves, further comprises:

separating said rough separation mixture according to granularity and particle size into rough separation portions, each portion being passed to the dry separation concentrator separately.

10. The method of claim 9, wherein the step of separating said rough separation mixture is by spot blanking, each portion being passed to a different dry separation concentrator for the steps of vibrating, separating, and collecting by line blanking, each portion having drop points less than 20 mm of each collection mixture.

11. The method of claim 7, wherein said airflow ventilation flows at 0.2-20 cm3/s, wherein vibration frequency of said first vibrator is 22-33 Hz with an amplitude of vibration of 0.3-3 mm, and wherein vibration frequency of said second vibrator being 20-33 Hz with an amplitude of vibration of 2-10 mm.

12. A method of separating minerals from ore, said method comprising:

providing a system according to claim 1 crushing materials into a mixture of ore and minerals;

drying said mixture of ore and minerals so as to form a dry mixture of ore and minerals;

storing and transporting said dry mixture in said materials feeding device;

passing said dry mixture from said materials feeding device to said materials feeding inlet of said dry separation concentrator;

vibrating said dry mixture on said perforated board at an angle of 2-20 degrees with said first vibration platform, said dry mixture being exposed to airflow ventilation;

separating said dry mixture by particle size by turbulence flow field across said perforated board; and collecting said dry mixture by particle size from said deposit outlet of said dry separation concentrator.

* * * * *